United States Patent [19]

Roth et al.

[11] Patent Number: 4,731,608

[45] Date of Patent: Mar. 15, 1988

[54] IMAGE CONTROL UNIT FOR A VIDEO DISPLAY UNIT

[75] Inventors: Roland Roth, Holzkirchen; Ivan Furjanic, Munich, both of Fed. Rep. of Germany

[73] Assignee: Siemens Aktiengesellschaft, Berlin and Munich, Fed. Rep. of Germany

[21] Appl. No.: 753,113

[22] Filed: Jul. 9, 1985

[30] Foreign Application Priority Data

Jul. 27, 1984 [DE] Fed. Rep. of Germany ..... 3427810

[51] Int. Cl.[4] ..... G09G 1/16

[52] U.S. Cl. ..... 340/734; 340/709; 340/749

[58] Field of Search ..... 340/731, 745, 721, 749, 340/748, 744, 734, 709

[56] References Cited

U.S. PATENT DOCUMENTS

| | | | |
|---|---|---|---|
| 3,617,772 | 11/1971 | Grosky | 340/749 |
| 3,696,387 | 10/1972 | Nussbaum | 340/749 |
| 4,093,221 | 6/1978 | Dash | 340/734 |
| 4,156,238 | 5/1979 | Glasson | 340/749 |
| 4,163,229 | 7/1979 | Bodin et al. | 340/735 |
| 4,228,430 | 10/1980 | Iwamura et al. | 340/709 |
| 4,283,724 | 8/1981 | Edwards | 340/749 |
| 4,309,700 | 1/1982 | Kraemer | 340/749 |
| 4,352,100 | 9/1982 | O'Connell | 340/734 |
| 4,354,185 | 10/1982 | Woborschil | 340/709 |
| 4,437,092 | 3/1984 | Dean et al. | 340/734 |
| 4,625,202 | 11/1986 | Richmond et al. | 340/734 |

FOREIGN PATENT DOCUMENTS 2075317 11/1981 United Kingdom .

OTHER PUBLICATIONS

Publication-8080 Wescon Technical Paper, vol. 26, Sep. 1982, pp. 1-13.

*Primary Examiner*—Marshall M. Curtis

*Attorney, Agent, or Firm*—Hill, Van Santen, Steadman & Simpson

[57] ABSTRACT

An image control unit, for generating control signals corresponding to text or graphic characters, in cooperation with a video display device having an image point storage device, produces plural signals including signals for controlling horizontal and vertical synchronization, for loading of the image point storage device, and for indicating reference marks on the screen of the video display unit. The image control unit contains a programmable memory for storing control words associated with lines to be represented on the video display unit in a plurality of blocks. A plurality of lines of each block are stored as one line in the memory and each line is read out repeatedly, in accordance with the line length of its associated block. The line length of each block is set by control signals stored in the ROM for the preceeding block.

11 Claims, 5 Drawing Figures

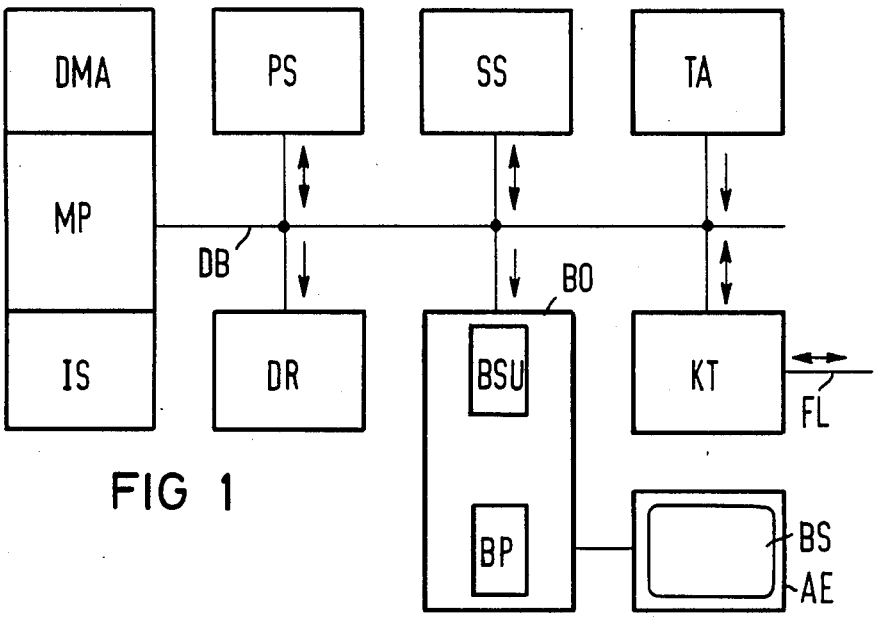
FIG 1
FIG 2
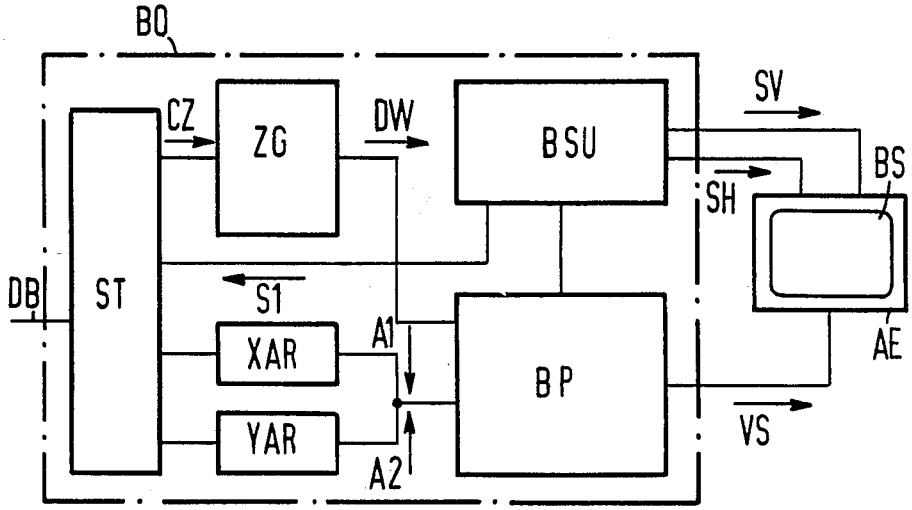

IMAGE CONTROL UNIT FOR A VIDEO DISPLAY UNIT

BACKGROUND

1. Field of the Invention

The present invention relates to an image control unit for a video display unit (VDU) and more particularly to a video display unit in which control signals are provided in connection with blocks of characters covering a plurality of successive lines.

2. Prior Art

Image control units for video display units are generally known, and are commercially available in the form of integrated circuits. They provide the signals required for operation of display units, in particular cathode ray tubes having standardised BAS signal inputs. However when display units are used which do not conform to the standardised BAS signal inputs, then the video display units do not achieve their maximum exploitation of the image area at high frame frequencies. Moreover, when such image control units require cooperation with microprocessors, an additional expense is often required for extra components associated with the microprocessor. If a slow displacement of the data displayed on the display unit (sometimes referred to as a soft-scroll), is required, additional signals must be generated at predetermined times during construction of the image.

It is desirable to provide an apparatus which can produce the necessary control signals without complicated and expensive constructions.

BRIEF SUMMARY OF THE INVENTION

It is a principal object of the present invention to provide an image control unit which is relatively uncomplicated and inexpensive, but which can nevertheless be adapted to various applications in connection with video display units.

This object is attained in the present invention by use of a data storage device, and with means for changing the contents of the data storage device in a highly flexible manner for various types of image construction on the display unit. In accordance with one favorable embodiment of the present invention, the memory is designed as a pluggable ROM, as an electrically programmable ROM (EPROM), or as a random access memory (RAM).

In the present invention, first, second and third counters are employed for manifesting character and line position within a block, and the block number. The line position counter is adjusted in accordance with block length signals which are stored in the data storage device, and which determine the length of the following block. The block length signals are advantageously stored in a serial fashion in the storage device, and are used to preset the second counter. The output of the second or line position counter is connected to a flip-flop which is set in the event of a carry from the second counter, and which has an output signal linked by logic to a line-end signal, also stored in the data stroage device, in order to increment the third counter, which manifests the block number.

For the soft-scroll facility, additional drive signals are required, which are stored in the storage device. Preferably, an intermediate storage device is employed, for storing binary characters assigned to the control storage intermediately relative to the main memory. The intermediate storage device can also store further binary characters which are supplied as video signals to display marks or framing lines which appear on the display unit.

In one embodiment of the present invention, control signals for a plurality of different types of image constructions on the display unit can be maintained in the storage device and one type of image construction can be manifested by a change-over switch.

BRIEF DESCRIPTION OF THE DRAWINGS

Reference will now be made to the accompanying drawings in which:

FIG. 1 is a functional block diagram of a video display system provided with an image generator incorporating the present invention;

FIG. 2 is a functional block diagram of the image generator of FIG. 1;

DESCRIPTION OF THE PREFERRED EMBODIMENT

Figure 3:
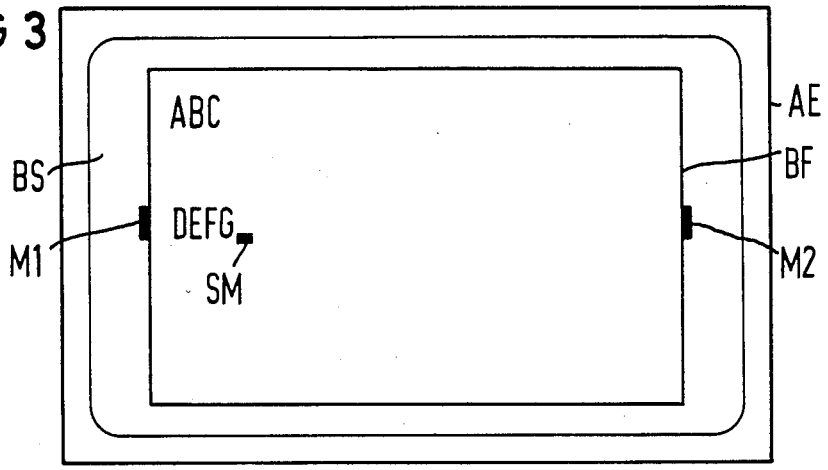
FIG. 3 is a pictorial illustration of an image on the screen of a display unit.

A system incorporating a video display unit or VDU is represented in FIG. 1. It includes a microprocessor MP which is connected to an interrupt control unit IS and also to a programmable direct memory access unit DMA. A data bus DB is connected from the microprocessor MP to an image generator BG. The data bus is also connected with a primary store unit PS, a secondary store unit SS, a keyboard TA, a printer DR, and a communications unit KT. A display unit AE is connected to the data bus DB through the image generator BG. The image generator BG includes an image control unit BS, and an image point store BP, as more fully described hereinafter.

The primary store PS is a semiconductor memory and serves as a program storage device and a working storage device. The secondary store SS is a non-volative storage device such as a floppy disk, or a magnetic bubble storage unit. The keyboard TA contains keys for alphanumeric characters, and function keys for the implementation of different functions of the apparatus. The printer DR is conventional, and may be daisy wheel type or a dot matrix type, etc. A communications interface KT is connected between the data bus DB and a trunk line FL for the transmission and reception of characters from a remote location.

When characters are represented on the screen of the display unit AE, code characters (for example ASCII characters) assigned to the characters being displayed are transferred from the primary storage unit PS or from a secondary storage unit SS, over the data bus DB, to the image generator BG. The image generator BG contains a character generator which, in known manner, contains data words in accordance with the form of the characters to be displayed. These data words are read out, in accordance with the code characters received from the data bus DB, and are transferred to an image point store or bit mapped memory BP. Each image point on screen of the display unit AE is assigned a storage element of the image point store BP. The image point storage device serves as the image repetition store from which the data words are read out in accordance with a repetition frequency, and transferred to the display unit AE. The screen of the display unit AE can be designed as a screen of a cathode ray tube. In this case, corresponding video signals are produced from the binary words stored in the image point store unit BP and are used to unblank the beam of the cathode ray tube. Alternatively, if the screen of the video display unit AE consists of individual image elements, then the video signals are fed to these image elements.

The characters are represented on the screen of the video display unit by a plurality of parallel scan lines, and the characters which are represented are composed from image points arranged on these lines.

Referring to FIG. 2, the inner structure of the image generator BG is illustrated. It contains a control unit ST which preferrably comprises a microprocessor. The control unit ST is connected at its input to the data bus DB. For each character to be displayed on the screen of the display unit, a code character CZ associated with the character to be displayed is transferred from the control unit ST to the character generator ZG in accordance with the control character received by ST from the data bus DB. The character generator ZG produces data words DW, which correspond to the form of the characters to be displayed, and they are stored in the image point store unit BP. The characters to be displayed are formed on a line-by-line basis, and each line of a character corresponds to one data word DW. In addition, address signals, corresponding to the coordinates of the location on the screen were the character is to be displayed, are transferred from the control unit ST into two registers XAR and YAR where they are intermediately stored. These registers are used to address the image point store unit BP, so that the data words DW are stored at the positions corresponding to the desired locations of the screen of the VDU. The data words are read out from the image point store BP in the form of video signals VS which are supplied to the display unit AE. In addition, horizontal and vertical synchronizing signals SH and SV are supplied to the video display unit AE from the image control unit BS, which is described in more detail in connection with FIGS. 3-5.

FIG. 3 illustrates a pictorial view of an image appearing on the screen of the display unit AE. An image field BF is illustrated, containing graphic patterns and alphanumeric characters. A cursor or write mark SM indicates the position at which the next character may be displayed. Two marks M1 and M2 also appear, aligned with the line containing the cursor SM, to indicate the line containing the cursor SM. As shown in FIG. 3, the display is normally black on white (or dark on light for a color VDU), with the marks M1, M2 and SM being dark, as well as the alphanumeric text.

Synchronizing signals SV and SH are required for vertical and horizontal synchronization of the VDU, and to supply blanking pulses for retrace of the beam of the CRT. These synchronizing signals are also employed in connection with request signals for the operation of the direct memory access unit DMA, for operation of the interrupt unit IS. Also, pulses indicating the completion of lines on the display screen are required. Mark signals are also required for representing the marks M1 and M2 on the screen of the display unit. These marks are generated in the image control unit BS. Components of the image control unit are illustrated in FIG. 4, which also shows associated components (ZS and G1) belonging to the image point storage unit BP.

Figure 4:
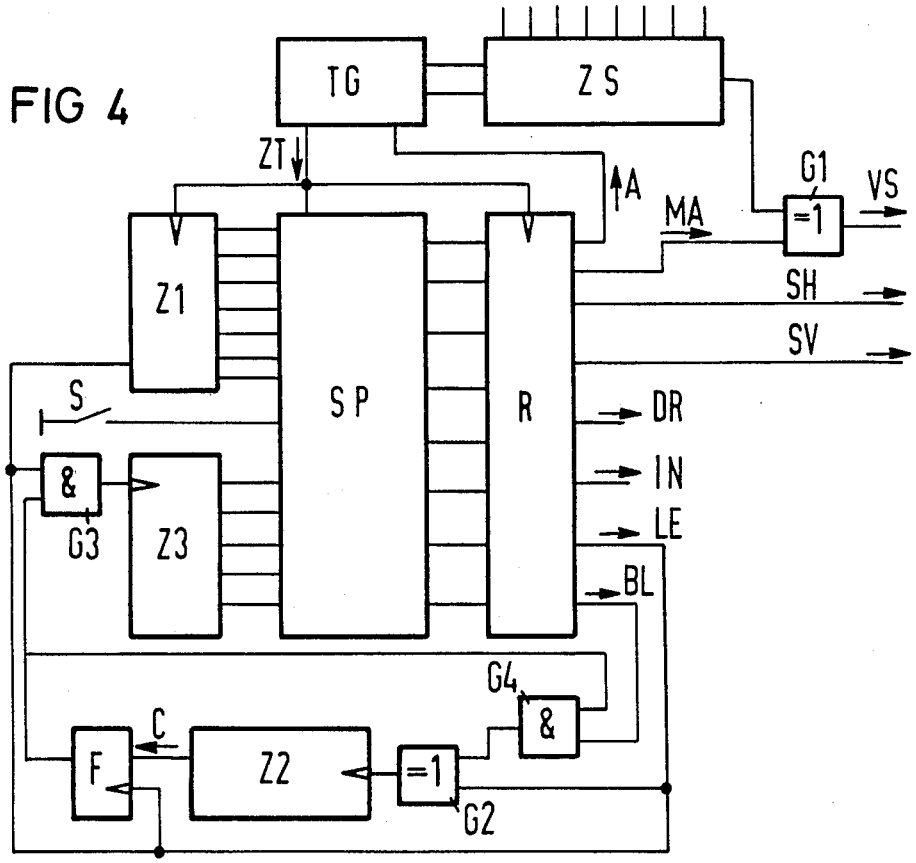
FIG. 4 is a functional circuit diagram of an image control unit together with cooperative parts of an image point storage unit contained within the image control unit.

In the circuit illustrated in FIG. 4, binary words comprising the control signals for image construction are stored in the storage unit SP. It is possible to provide a storage unit SP which is sufficiently large to store the characters for all lines of the screen of the video display unit AE. However this requires a relatively large memory for displays in which lines may have 109 storage positions each, with 318 lines representable on the screen. For the image area BF, shown in FIG. 3, 82 character positions and 300 lines are typically used. However, since may lines are identical, it is expedient to combine the binary characters of identical lines to form blocks, and to store these in a single row of the storage unit SP, with an indication of how many times, corresponding to block length, this storage row should be read out.

The storage unit SP is advantageously designed as a ROM. The ROM may be either pluggable, so that it can be exchanged for a ROM with a different code, or can be designed as an EPROM (electrically programmable ROM). This storage unit SP is cyclically addressed and stored control words are emitted from its data outputs corresponding to each separate address. The control words each hve 8 bits. Two of the bite (LE and BL) control the addressing of the storage unit SP.

The addressing of the storage unit SP takes place with the assistance of three counters Z1-Z3. The binary outputs of the counters Z1 and Z3 are connected to the address inputs of the ROM SP. One other address input is connected to a switch S, as more fully described hereinafter. The counter Z1 counts the character positions along a line (for example 109). The counter Z2 counts the number of identical lines within a block, and the counter Z3 indicates the block number.

The storage unit SP is connected at its output to an intermediate storage register R, which functions as a latch register, and manifests the bits of the control word which was last accessed. The image control unit shown in FIG. 4 also contains a clock pulse generator TG, which provides clock pulses to the storage unit SP, to the intermediate storage register R2, and to the counter Z1. The pulse generator TG also controls an intermediate storage device ZS, which functions as a parallel to serial converter, to provide serial bits to the display unit in accordance with the words stored in the memory of the image point storage unit (FIG. 2). These bits generate the video signal VS.

Figure 5:
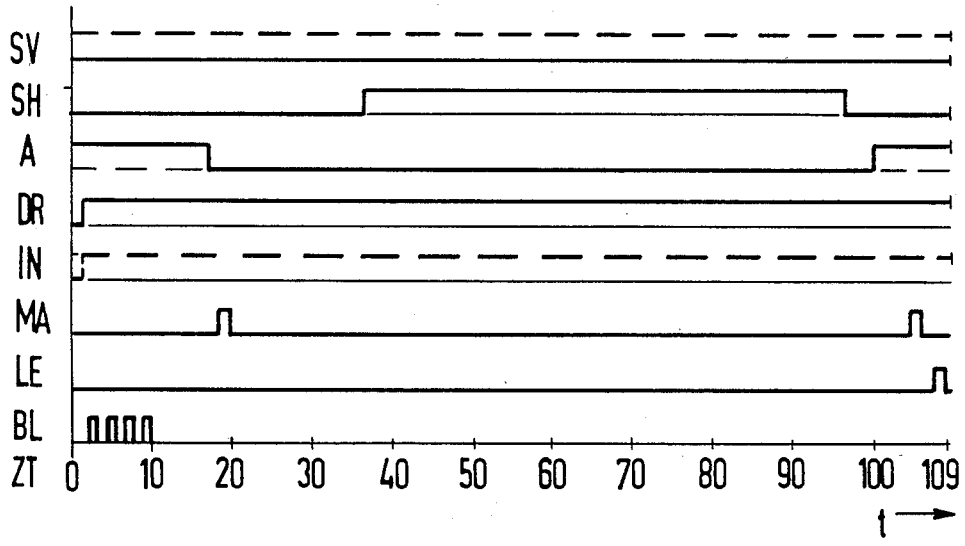
FIG. 5 is a plurality of time-diagrams of signals at various points during operation of the image control unit.

The timing of various operations of a circuit of FIG. 4 is illustrated in FIG. 5 which shows a number of time diagrams, with time and the direction of the abscissa. The ordinate direction shows a logical "1" or "0" for each bit of the control words. At the bottom of FIG. 5, successive clock pulses ZT are indicated by numerals which indicate the number of clock pulses occurring during the period of the diagrams.

The signals represented in solid lines in FIG. 5 are associated with a block which represents 12 lines on the screen, which twelve lines are arranged approximately in the center of the screen, and with which the marks M1 and M2 can be represented. The other blocks differ from this block normally only in the broken line signal SV (for vertical synchronization) and the stored drive signals DR and IN. In the case of other blocks, block length signal BL contains either no pulses, or a different number of pulses, in accordance with the length of the respective block.

In operation, the counter Z1 (FIG. 4) counts the pulses of the pulse train ZT, and successive control words are read out from the storage unit SP, and intermediately stored in the register R, one for each clock pulse, corresponding to the time required to display one character. In FIG. 5, the signal SV has a binary value 0 and is thus inactive. The signal SH (for horizontal synchronization) has the binary value 0 which is assigned to its active state. A blanking signal A (FIG. 4), which determines the zone in which characters can be represented on the video screen, has a binary value 1 and is inactive. A stored drive signal DR, by which direct access can be gained to the storage unit PS, has a binary value 0 and is thus active in order to call up from the storage unit PS the characters which are represented, using the line which is to be displayed. A further storage drive signal IN, which is an interrupt signal, can be active at this time if the soft-scroll facility is required. Otherwise it is inactive.

In synchronism with the clock pulses ZT, control words corresponding to the 109 character positions of a line are read out consecutively, so that the control signals illustrated in FIG. 5 occur for the line which is currently to be displayed, and which is defined by the line stored in the line counter Z1 and by the block number stored in the counter Z3. As illustrated in FIG. 5, approximately at the time of the clock pulse ZT17, the blanking signal A becomes active, which signal is applied to the clock pulse generator TG and enables the same to emit clock pulse signals at a high pulse repetition rate, corresponding to the bit pitch of dots making up the characters on the display screen. These high rate pulses are applied to the storage unit ZS, so that data words stored in the image point storage unit BP can be converted into the serial video signals VS. These are supplied through an OR gate G1 to the display unit AE. Shortly thereafter, a mark signal MA occurs, which serves to represent the write row mark M1. This mark signal MA is fed also to a second input of the OR gate G1 (FIG. 4), so it can form part of the video signal VS, to make the display dark at this point.

Subsequently, signal SH assumes the value of binary 1 and this becomes inactive. Later on it becomes active again, approximately at the time of the counting clock pulse ZT97, at which time it initiates the horizontal synchronization. Then the blanking signal A becomes inactive again, thus blocking signals from the pulse generator TG to the storage unit ZS, whereby no further characters are represented on the screen. Directly afterwards, another mark signal MA again occurs, in order to represent the right hand row mark M2 on the screen.

At the approximate time of the clock pulse ZT109, the line ends signal LE occurs. This signal is provided to the counter Z2, through an OR gate G2 (FIG. 4), to increment the counter, i.e., increase the counter by one. If the line which has just been displayed is not the last line of the current block, the counter Z3 remains unchanged. The counter Z1 is reset by the signal LE and begins to count upwards again, so that the same memory areas of the storage unit SP are accessed, so that the same control signals are produced for a subsequent line. This continues for subsequent lines until the end of the block is reached. At that time, the counter Z2 produces a carry signal C, which is connected to the set input of a flip-flip F. When the counter F is set, it supplies a signal to an AND gate G3. The second input of the AND gate G3 is connected to receive the LE signal, and its output is connected to the input of the counter Z3. Accordingly, at the end of a block, the counter Z3 is incremented, in order to address the next block within the ROM SP.

If the next block has the same length which corresponds to the fixed counting range of the counter Z2, then the counter Z2 is cycled through its range again, before it emits another carry signal C, for the next block to be addressed. If however the next block has a smaller number of lines, then the counter Z2 is caused to count upwards by block signals BL emitted from the register R. These signals are supplied to an AND gate G4, which also receives the output of the flip-flop F. When the flip-flop F is set, the AND gate G4 is enabled, so that the pulses of the signal BL serve to increment the counter Z2 during the last line of the preceding block. Then, when the LE signal occurs along with the carry signal C, the counter Z3 is incremented and the flip-flop F is reset. In the example illustrated in FIG. 5, the next block is 12 lines in length and so four pulses BL are produced. These pulses effectively preset the counter Z2, giving it an effective radix of 12, instead of the unmodified radix of Z2 which is 16.

The radix of the counter Z3 is preferably 32, so that up to 32 different blocks are available for the generation of the control signals. Expediently the counter Z3 is reset by the vertical synchronization signal SV, or alternatively may be preset at the beginning of each frame (by means now shown) by the microprocessor ST, under control of signals received over the data bus DB. The counter Z1 preferably has a radix of 128. However, since only 109 characters are used in the illustration of FIGS. 3 and 5, the counter Z1 is reset by the LE signal after 109 states.

During the display of the last 15 lines, the control signal SV has the binary value 1, and is thus activated in order to carry out vertical synchronization. Therefore the signal SV has been illustrated in broken lines in FIG. 5, since vertical synchronization is not occuring during the period illustrated in FIG. 5.

For the soft-scroll facility, the store drive signal IN temporarily assumes a binary value 0, and is thus activated in order to trigger a rapid restorage of the video information assigned to the lines. When this takes place, the data stored in the image point store unit BP is shifted, to represent an upward incremental movement of the lines displayed on the screen of the display unit.

A switch S is connected to an address input of the storage unit SP by which, the highest value address bit may be switched over, in order to trigger various images on the screen of the video display unit. When the switch S is open, for example, a test image is represented and when the switch is closed, an image is constructed which corresponds to the image illustrated in FIG. 3, in which the alphanumerical characters can be represented in the image area BF.

Various modifications and additions in the apparatus of the present invention will be apparent to other skilled in the art, without departing from the essential features of novelty thereof, which are intended to be defined and secured by the appended claims.

What is claimed is:

1. An image control unit for a video display for generating control signals serving to construct an image on a display unit, including, in combination, a storage device for storing a plurality of sequence control words corresponding to groups of one or more raster lines displayed on said display unit, each of said sequence of control words being associated with a block of identical raster lines to be displayed, a first counter having an output connected to address inputs of said storage device, means for incremeting said first counter for each character to be represented on said video display, whereby said storage device successively reads out control words corresponding to the characters to be represented on a raster line of said display device, a second counter, means connected to said second counter and to said storage device for setting said second counter to a predetermined block length, in accordance with said control words, said second counter being connected to receive an output from said storage device corresponding to a raster line-end signal stored therein to count the raster lines of a block, and a third counter having its output connected to address inputs of said storage device and its input connected to an output of said second counter, whereby said third counter is incremented after a given sequence of control words when said storage device has been accessed a number of times equal to the number of raster lines in its associated block.

2. Apparatus according to claim 1 wherein said storage device is a ROM.

3. Apparatus according to claim 1 or 2 wherein said storage device is an electrically programmable ROM.

4. Apparatus according to claim 1 or 2 wherein said storage device is a random access memory.

5. Apparatus according to claim 1 wherein one or more of said control words include a bit comprising a block length bit, and means for presetting said second counter by incrementing it successively for each of said block length bits.

6. Apparatus according to claim 1 including a flip-flop connected to the output of said second counter for manifesting an output signal in response to an output signal received from said second counter corresponding to a predetermined number of raster lines, and an AND gate having one input connected to receive the output of said flip-flop and a second input connected to receive said line-end signal, the output of said AND gate being connected to an input of said third counter, whereby said third counter is incremented by said raster line-end signal after said flip-flop has been set.

7. Apparatus according to claim 1 wherein said control words include bits for manifesting horizontal and vertical synchronizing signals for said video display.

8. Apparatus according to claim 1 wherein said control words include a blanking bit for enabling or disabling the output from said image point storage device, for controlling the locations on said video display at which information is to be displayed.

9. Apparatus according to claim 1 wherein said control words include one or more control bits for controlling introduction of data into said image point storage device.

10. Apparatus according to claim 1 including an intermediate storage unit connected to the output of said storage device, for intermediately storing outputs from said storage device.

11. Apparatus according to claim 1 wherein said storage device stores sequences of control words for a plurality of images to be displayed on said display unit, including switch means connected to an address input of said storage unit for manually selecting one of said sequence.

* * * * *